SR
10/22/85 OR 4,548,326

United States Patent [19]
Danna et al.

[11] Patent Number: 4,548,326
[45] Date of Patent: Oct. 22, 1985

[54] STADIUM SEAT ARM GRIPPING TRAY

[76] Inventors: John M. Danna, 8502 Organdy La., Santee, Calif. 92071; Mark Speros, 3611 N. Euclid Ave., San Diego, Calif. 92105

[21] Appl. No.: 652,713

[22] Filed: Sep. 21, 1984

[51] Int. Cl.[4] ..... A47F 7/28
[52] U.S. Cl. ..... 211/71; 108/26; 211/86; 297/194; 248/231.8
[58] Field of Search ..... 211/71, 86; 297/194, 297/188, 145, 153, 161; 108/25, 26; 248/221.4, 72, 73, 231.8, 228, 214

[56] References Cited

U.S. PATENT DOCUMENTS 2,963,761 12/1960 Haydock ..... 297/153 X
3,131,447 5/1964 Tinnerman ..... 248/231.8
3,233,940 2/1966 Tooley ..... 297/194
3,338,628 8/1967 Evans ..... 297/188
3,675,969 7/1972 Gage ..... 297/194
3,690,724 9/1972 Douglas et al. ..... 297/194
4,247,070 1/1981 Dirksing ..... 248/231.8
4,262,962 4/1981 Yust ..... 297/194

*Primary Examiner*—Robert W. Gibson, Jr.
*Attorney, Agent, or Firm*—Charles C. Logan, II

[57] ABSTRACT

A tray adapted to be detachably secured to the arm of a stadium or theater seat. The stadium seat tray has a tray portion and an arm portion. The tray portion has a pair of recesses formed in it for receiving a beveridge or food container. The arm portion has downwardly extending side walls which have structure formed thereon for matingly engaging the horizontal arm rest portion of the stadium seat.

2 Claims, 6 Drawing Figures

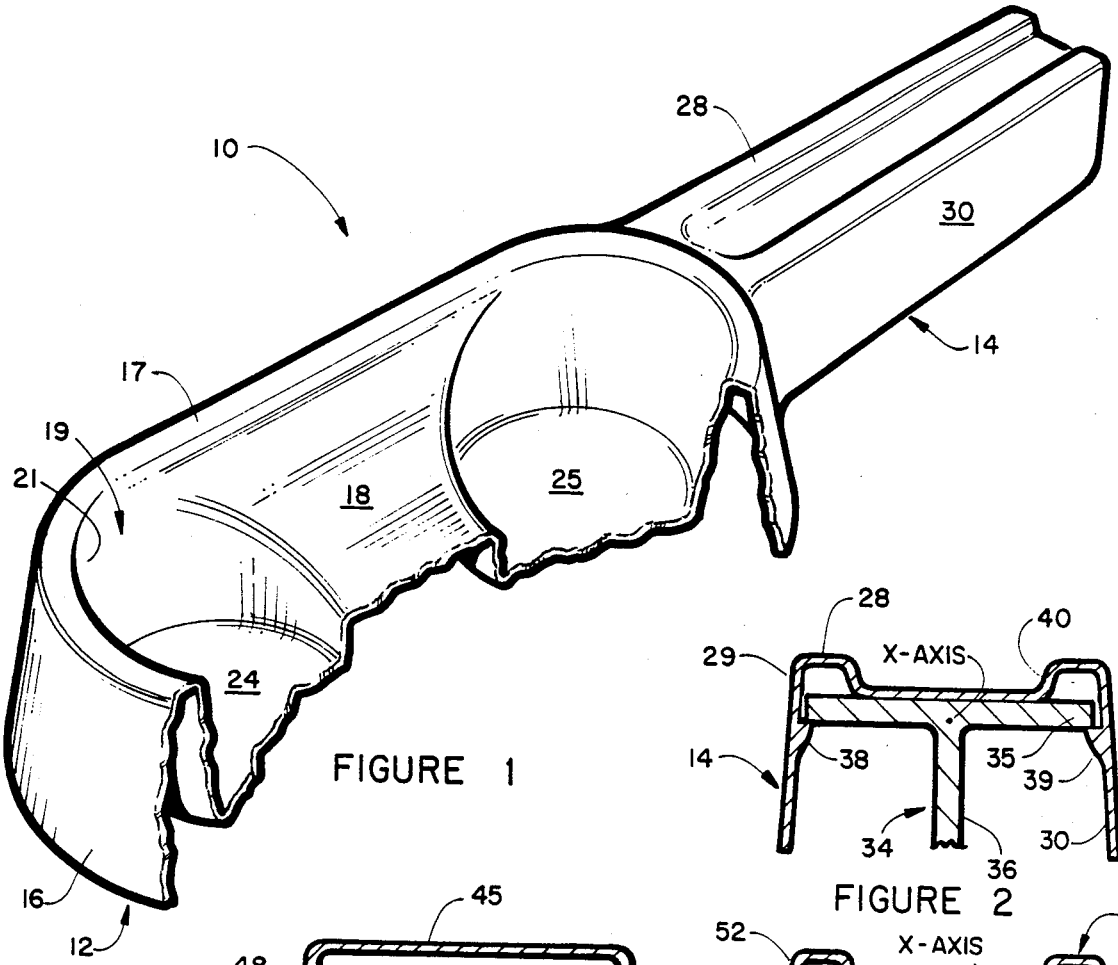
FIGURE 1
FIGURE 2
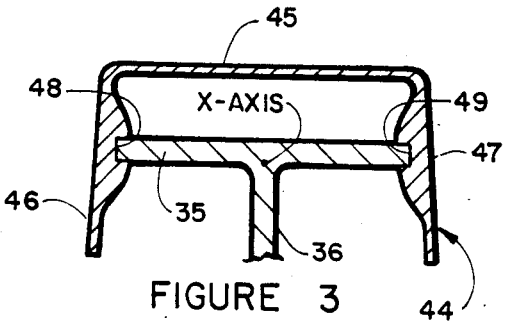
FIGURE 3
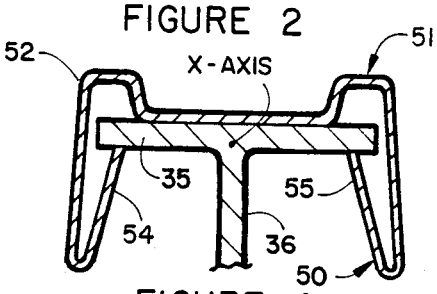
FIGURE 4
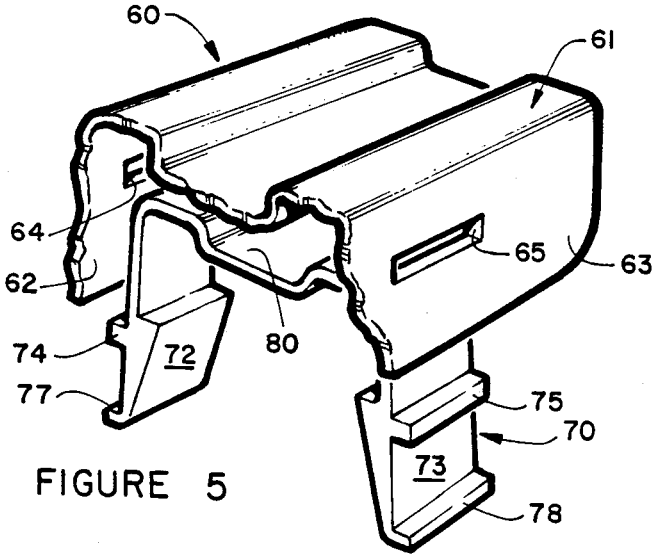
FIGURE 5
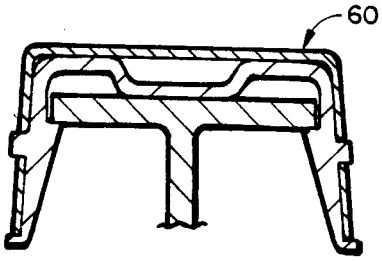
FIGURE 6

STADIUM SEAT ARM GRIPPING TRAY

DESCRIPTION OF THE DRAWINGS

FIG. 1 is a perspective view of Applicant's novel stadium seat tray with portions broken away to provide added clarity;

FIG. 2 is a cross sectional elevation view illustrating how the arm portion of the stadium seat tray of FIG. 1 is detachably secured to the stadium seat arm reat assembly;

FIG. 3 illustrates in a vertical cross sectional view a first alternative embodiment for the arm portion structure of the stadium seat tray;

FIG. 4 illustrates in a vertical cross sectional view a second alternative embodiment for the arm portion structure of the stadium seat tray;

FIG. 5 is a partial perspective view illustrating an alternative structure for the arm portion of the stadium seat tray and U-shaped adapter member which is utilized with this version; and FIG. 6 is a vertical cross sectional view illustrating how U-shaped adapter member illustrated in FIG. 5 is detachably secured to the horizontal arm rest portion of the stadium seat arm rest assembly.

DESCRIPTION OF THE PREFERRED EMBODIMENT

Applicant's novel stadium seat tray will be described by referring to FIGS. 1-6 of the drawings. The stadium seat tray is generally designated numeral 10. It has a tray portion 12 and an arm portion 14.

Tray portion 12 has an outer wall 16 with a top edge 17. The top surface 18 of tray portion 12 has a front recess 19 and a rear recess 20 formed therein. These recesses have cylindrical walls 21 and 22 respectively for receiving drink or food containers therein. Front recess 19 has a bottom wall 24 and rear recess 20 has a bottom wall 25.

Arm portion 14 has a top wall 28 with side walls 29 and 30 extending downwardly from its lateral longitudinal edges.

In FIG. 2 the stadium arm rest assembly 34 is illustrated in cross section. Stadium seat arm rest assembly 34 has a horizontal arm rest portion 35 having a longitudinally extending x-axis. A brace portion 36 extends vertically downwardly from the the x-axis. Lips 38 and 39 extend inwardly from the respective side walls 29 and 30 and the top of these lips engages the bottom surface of horizontal arm rest portion 35. A recess 40 is formed in top wall 28 and its bottom surface engages the top surface of horizontal arm rest portion 45.

An alternative structure for the arm rest portion is illustrated in FIG. 3 and it is generally designated numeral 44. It has a top wall 45 and downwardly extending side walls 46 and 47. A longitudinally extending channel 48 is formed in the inner surface of side wall 46 and a longitudinally extending channel 49 is formed in the inner surface of side wall 47. The opposite ends of horizontal arm rest portion 35 are captured in these respective channels 48 and 49.

A second alternative structure for the arm portion is illustrated in FIG. 4 and it is generally designated numeral 50. It has a top wall 51 with downwardly extending side walls 52 and 53. Spring fingers 54 and 55 are formed on the bottom of the respective side walls 52 and 53 and these extend upwardly and inwardly with their top ends in engagement with the bottom surface of horizontal arm rest portion 35. Top wall 51 has a recess 57 formed in it and its bottom surface is engagement with the top surface of horizontal arm rest portion 35.

In FIGS. 5 and 6, an alternative arm portion 60 is illustrated. It has a top wall 61 with downwardly extending side walls 62 and 63. Slots 64 and 65 are formed in these respective side walls. A U-shaped adapter member 70 is utilized with this configuration and it has a top wall 71 with downwardly extending spring fingers 72 and 73. On the outer surface of these respective spring fingers are formed tongue members 74 and 75 respectively that mateingly engage with slots 64 and 65.

What is claimed is:

1. A tray device for use in association with the arm rest assembly of a stadium seat, which arm rest assembly has a substantially horizontal arm rest portion with an upright brace portion extending downwardly from its longitudinal axis such that a vertical cross-section taken laterally through said arm rest assembly is substantially T-shaped, said tray device comprising, in combination:

an elongated tray portion having an elongated arm portion connected to its one end;

said tray portion having means for supporting at least one container;

said arm portion having an elongated top wall with laterally spaced side walls extending downwardly from its lateral edges; and means for detachably securing said arm portion to said arm rest assembly comprising a U-shaped adapter member having a top wall with a pair of laterally spaced downwardly extending spring fingers, said spring fingers each having an inwardly extending lip that engages the bottom surface of the horizontal arm rest portion of the stadium seat, said spring fingers also having tongue members that extend outwardly therefrom and these are detachably secured into mating slots formed in the side walls of the arm portion of the tray device.

2. A tray device for use in association with the arm rest assembly of a stadium seat, which arm rest assembly has a substantially horizontal arm rest portion with an upright brace portion extending downwardly from its longitudinal axis such that a vertical cross-section taken laterally through said arm rest assembly is substantially T-shaped, said tray device comprising, in combination:

an elongated tray portion having an elongated arm portion connected to its one end;

said tray portion having means for supporting at least one container;

said arm portion having an elongated top wall with laterally spaced side walls extending downwardly from its lateral edges, said top wall of the arm portion has a recess formed therein whose bottom surface is in surface contact with the top surface of said horizontal arm rest portion of the stadium seat;

means for detachably securing said arm portion to said arm rest assembly comprising a spring finger on the inside surface of each of the said side walls of the arm portion and these fingers extend upwardly and inwardly such that their upper ends engage the bottom surface of the horizontal arm rest portion of the stadium seat; and said arm rest portion, said tray portion and said means for detachably securing said arm portion to said arm rest assembly being integrally formed as a single member.

* * * * *